US005790924A

United States Patent [19]

Creutzmann et al.

[11] Patent Number: 5,790,924

[45] Date of Patent: Aug. 4, 1998

[54] MULTI-FUNCTIONAL PRINTER DEVICE HAVING MODULAR STRUCTURE

[75] Inventors: Edmund Creutzmann, Markt Schwaben; Walter Kopp, Taufkirchen; Helmut Reichl, Fürstenfeldbruck, all of Germany

[73] Assignee: Siemens Nixdorf Informationssystem Aktiengesellschaft, Paderborn, Germany

[21] Appl. No.: 624,460

[22] PCT Filed: May 12, 1995

[86] PCT No.: PCT/DE95/00635

§ 371 Date: Apr. 1, 1996

§ 102(e) Date: Apr. 1, 1996

[87] PCT Pub. No.: WO96/02872

PCT Pub. Date: Feb. 1, 1996

[30] Foreign Application Priority Data

Jul. 15, 1994 [DE] Germany ..... 44 25 074.6
Oct. 6, 1994 [DE] Germany ..... 44 35 757.5

[51] Int. Cl.[6] ..... G03G 15/00

[52] U.S. Cl. ..... 399/110; 399/38; 399/384; 399/401

[58] Field of Search ..... 399/38, 110, 384, 399/364, 401; 347/153, 154; 226/108, 197; 242/538.2, 538.3

[56] References Cited

U.S. PATENT DOCUMENTS

| | | | |
|---|---|---|---|
| 4,835,567 | 5/1989 | Ogata | 399/124 |
| 4,905,053 | 2/1990 | Matsuo et al. | 399/402 |
| 5,379,101 | 1/1995 | Takahashi et al. | 399/110 |
| 5,384,619 | 1/1995 | Yokomizo et al. | 399/364 X |
| 5,467,179 | 11/1995 | Boeck et al. | 399/384 |
| 5,546,178 | 8/1996 | Manzer et al. | 399/384 |
| 5,568,245 | 10/1996 | Ferber et al. | 399/384 |

FOREIGN PATENT DOCUMENTS

| | | |
|---|---|---|
| 0154695 | 9/1985 | European Pat. Off. . |
| 0225546 | 6/1987 | European Pat. Off. . |
| 0432298 | 6/1991 | European Pat. Off. . |
| 0572050 | 12/1993 | European Pat. Off. . |
| U9218167 | 10/1993 | Germany . |
| 60-42774 | 3/1985 | Japan . |
| 92/15513 | 9/1992 | WIPO . |
| 94/27193 | 11/1994 | WIPO . |

OTHER PUBLICATIONS

E. C. McIrvine, "Method for Duplex Printing on Continuous Web Paper", Xerox Disclosure Journal, vol. 9, No. 3 May/Jun. 1984, pp. 201–203.

IBM Technical Disclosure Bulletin, Paper–Reversing Guide for Duplex Printing, vol. 28, No. 7, Dec. 1985, pp. 2835–2836.

*Primary Examiner*—Arthur T. Grimley
*Assistant Examiner*—Sophia S. Chen
*Attorney, Agent, or Firm*—Hill, Steadman & Simpson

[57] ABSTRACT

An electrophotographic printer device for both-sided printing of a tape-shaped, narrow recording medium (10) and for single-sided printing of a wide recording medium or a plurality of parallel, narrow recording media (10/1,10/2,10/3) contains a printer module that is designed for printing recording media differing in width. A delivery module and a turn-over module (28) are removably arranged in the printer module, the narrow recording medium (10) being turned over after the printing of the front side and being reconducted through the printer module for printing the back side via said delivery module and turn-over module.

13 Claims, 13 Drawing Sheets

MULTI-FUNCTIONAL PRINTER DEVICE HAVING MODULAR STRUCTURE

BACKGROUND OF THE INVENTION

1. Field of the Invention

The present invention is directed to a multi-functional electrophotographic printer device for printing web-shaped recording media differing in web width that has a modular structure.

2. Description of the Related Art

A high economic benefit to the customer and a broad spectrum of flexibility are expected from modem electrographic printer systems to a greatly increasing extent. Both the effective utilization of printing materials as well as the flexible fashioning of the print information play a large part therein.

Endlessly processing (using fan-fold paper) electrographic printer systems that print a web-shaped recording medium on one side have prevailed everywhere in the marketplace where a high device availability given high printing volume and a broad spectrum of material to be printed are demanded. These printer systems, however, have the disadvantage that it is not possible to change between single-sided and double-sided printing. For the user, this leads both to an economically unfavorable situation as well as being contrary to contemporary demands to maximize raw materials' utilization. Many customized applications that require double-sided printing (brochures, books, etc.) can thus not be satisfied, especially since electrographic high-performance printers are especially efficient when they are operated as free of interruption as possible.

For producing multi-color and two-sided printing with electrographic printer devices processing continuous stock, European Patent Document EP-B1-01 54 695 discloses that two continuous stock printers be operated following one another, whereby the paper printed in the first printer is turned over and is subsequently printed on the second side in the second printer.

The outlay is substantial due to the required, second printer.

The publication reference IBM Technical Disclosure Bulletin, Vol.22, No.6, November 1979, page 2466, FIG. 2, also discloses an electrophotographic printer device for printing web-shaped recording media with which it is possible to print the recording medium on both sides. To this end, the recording medium is pulled from a supply stack, supplied to a transfer printing station and provided with toner images on one side. After the fixing step, the recording medium is turned over and is resupplied to the transfer printing station. Another fixing step in the fixing station ensues after the back side of the recording medium has been printed with toner images.

This reference fundamentally discloses duplex printing with continuous stock recording media. The proposal, however, never led to a product. Further, the electrographic printer device disclosed therein is only suited for both-sided printing of the recording medium. A change of operating modes is not provided by the proposed device. The turn-over means composed of deflection rods that is employed therein requires manual threading of the recording medium; further, the nature of the arrangement of the deflection rods requires much installation space.

A printer device for front side and back side printing of a web-shaped recording medium has also already been proposed that contains units that generate toner images on appertaining intermediate carriers toner images, a transfer printing station that transfers the toner images onto the recording medium and a fixing station which respectively have a usable width of at least double the web width of the recording medium. After the front side is printed, the recording medium is conducted via a return channel from the fixing station to a turn-over station in which it is turned over and resupplied to the transfer printing station for printing the back side.

The function of such a printer device in pure simplex mode, i.e. given single-sided printing of, for example a wide or a plurality of narrow recording media arranged side-by-side, is limited. Thus, the functional elements such as duplex return in the return channel and the turn-over station required only in duplex mode, i.e. given two-sided printing of, for example, a single, narrow recording medium, require much space and deteriorate the handling. The turn-over station limits the employable stack width (forms length) of the recording medium in the supply region. The duplex return unit arranged under the exit region of the fixing station in turn limits the stack height of an internal stacker means.

SUMMARY OF THE INVENTION

It is therefore an object goal of the invention to provide a multi-functional printer device for front side and/or back side printing of web-shaped recording media that enables a simple change of operating modes and that can be operated unrestricted both in simplex mode as well as in duplex mode.

This object of the invention is achieved by an electrographic printer module of a usable width of at least twice the web width of a narrow recording medium, the printer module containing means that generates toner images and a thermal fixing station with a paper output channel via which the recording media leave the printer module, as well as a delivery channel to supply recording media of different web widths from an internal and/or external supply region to the means for generating toner imates;

a turn-over module that can be coupled to the paper output channel via a return channel and to the delivery channel, the turn-over module being constructed as an independent structural unit that can be interchangeably secured in the printer module, whereby in a first operating mode of the printer device for two-sided printing of the narrow recording medium, the recording medium, for printing the front side, passes through the printer module up to the paper output channel of the fixing station proceedings from the supply region and, for printing the back side, is resupplied to the printer module therefrom via the return channel and turned over via the turn-over module, and is output via the paper output channel of the fixing station, and in a second operating mode of the printer device for single-sided printing of an individual broad recording medium or parallel printing of a plurality of narrow recording media, the recording medium or media pass through only the printer module, proceeding from the supply region and are output via the paper output channel.

Advantageous embodiments are characterized provided by a multi-functional printer device as described above including a return module for the narrow recording medium that contains the return channel and comprises paper conveying elements, the return module being constructed as an independent structural unit that can be interchangeably secured in the printer module. The printer may also include coupling devices that interchangeably accept the turn-over module and/or the return module in receptacle regions of the printer module, the coupling devices having mechanical and/or electrical coupling means. The coupling device may include a displacement means that removable accepts the modules. The coupling device may include a centering device that positions the modules in a work position in the appertaining receptacle region of the printer module.

In a preferred embodiment, the printer device has a receptacle region for the return module arranged under the paper output channel of the fixing station, as well as a delivery means to an internal or external deposit means for the recording media that is fashioned displaceable into the region of the paper output channel or, with the return module present, into the region of an output channel allocated to the return module. An internal supply region that comprises a receptacle region for the turn-over module may be included.

A monitoring means that senses the presence or, respectively, absence of the modules via electrical sensor means and, depending on the modules sensed, supplies a signal to a control system that controls device functions of the printer device.

Preferably, a turn-over module that comprises an automatic threading means for the narrow recording medium is provided. An exemplary embodiment of the turn-over module has a paper admission channel and a paper output channel that are arranged next to one another; a first oblique deflection means that laterally deflects the recording medium supplied via the paper admission channel; a first reversing means following the first oblique deflection means in the paper conveying direction for returning the recording medium behind the paper channels into the region of a second reversing means that is arranged approximately parallel to the first reversing means and that again reverses the recording medium; a second oblique deflection means that follows the second reversing means and deflects the recording medium into the paper output channel; and a threading means for the recording medium, having a motor-driven gripper element guided around the reversing means and comprising gripper means for the start of the recording medium, whereby, for threading into the turn-over means, the start of the recording medium is seized in the region of the first oblique deflection means and is conveyed over the reversing means and the second oblique deflection means into the region of the paper output channel.

The return channel includes a motor-driven traction roller pair at the input side with a preceding centering means for the narrow recording medium; a motor-driven traction roller pair at the output side having a transport roller and a pressure roller that are seated displaceable relative to one another; and a connecting channel arranged between the traction roller pairs whose channel width is dimensioned such that a buckling of the recording medium is largely prevented.

The multi-functional printer device preferably has a shunt following the traction roller pair of the input side in the conveying direction of the recording medium, the shunt having a first operating position wherein the narrow recording medium is conducted into the connecting channel for printing the back side; and having a second operating position wherein a recording medium that is printed on only the front side is conducted into an output channel. The traction roller pair of the input side may have a transport roller and a pressure roller that are seated displaceable relative to one another, so that, in the opened displaced condition, a through channel for the recording media printed on only one side forms between the rollers.

Given this printer device, the two additional units being the duplex return unit and the turn-over unit are modularly removably secured in the basic mechanism of the printer module. In detail, this means the following:

The duplex return unit is mounted on guide rails that allow the operator to remove the complete unit from the working position in the printer with a few simple manipulations. No tools are required for this purpose. The mechanical interface is designed such that the unit is automatically centered and fixed in its working position upon reintroduction into the printer. The electrical interface is designed such that the plugged-in connection is automatically restored upon reintroduction into the printer. The turn-over unit is likewise mounted on guide rails that allow the operator to remove the complete unit from the working position in the printer with a few simple manipulations. No tools are required for this purpose. The mechanical interface is designed such that the unit is automatically centered and fixed in its working position upon reintroduction into the printer. The electrical interface is designed such that the plugged-in connection is automatically restored upon reintroduction into the printer. A compressed air delivery is additionally required for the turn-over unit. The interface provided for this purpose is likewise implemented such that the plugged-in connection is automatically restored upon reintroduction into the printer.

The electronic control of the printer automatically recognizes the presence or, respectively, the absence of the units for duplex return operation and the turn-over unit with sensors. An independent determination can thus be made via the printer device that, with the duplex return unit removed, that the maximum height of the paper stack to be processed can again be increased in the output drawer of the printer by the structural height of the duplex return unit and, when the turn-over unit is removed, the maximum height of the paper format to be processed can again be increased by the structural width of the turn-over unit.

Whenever one of the two units, the duplex return or the turn-over unit, is removed from the printer, the electronic device controller fully automatically switches all device function to simplex mode, and the electronic device controller fully automatically outputs error messages if the operator of the printer attempts to access duplex functions.

The unrestricted functionality of a simplex printer is reestablished for the simplex mode with these devices.

The overall printer system can thus be operated either as a simplex printer with unrestricted simplex functionality or as a duplex printer with full duplex functionality.

BRIEF DESCRIPTION OF THE DRAWINGS

Embodiments of the invention are shown in the drawings and are described in greater detail below by way of example. Shown are.

DETAILED DESCRIPTION OF THE PREFERRED EMBODIMENTS

Figure 1:
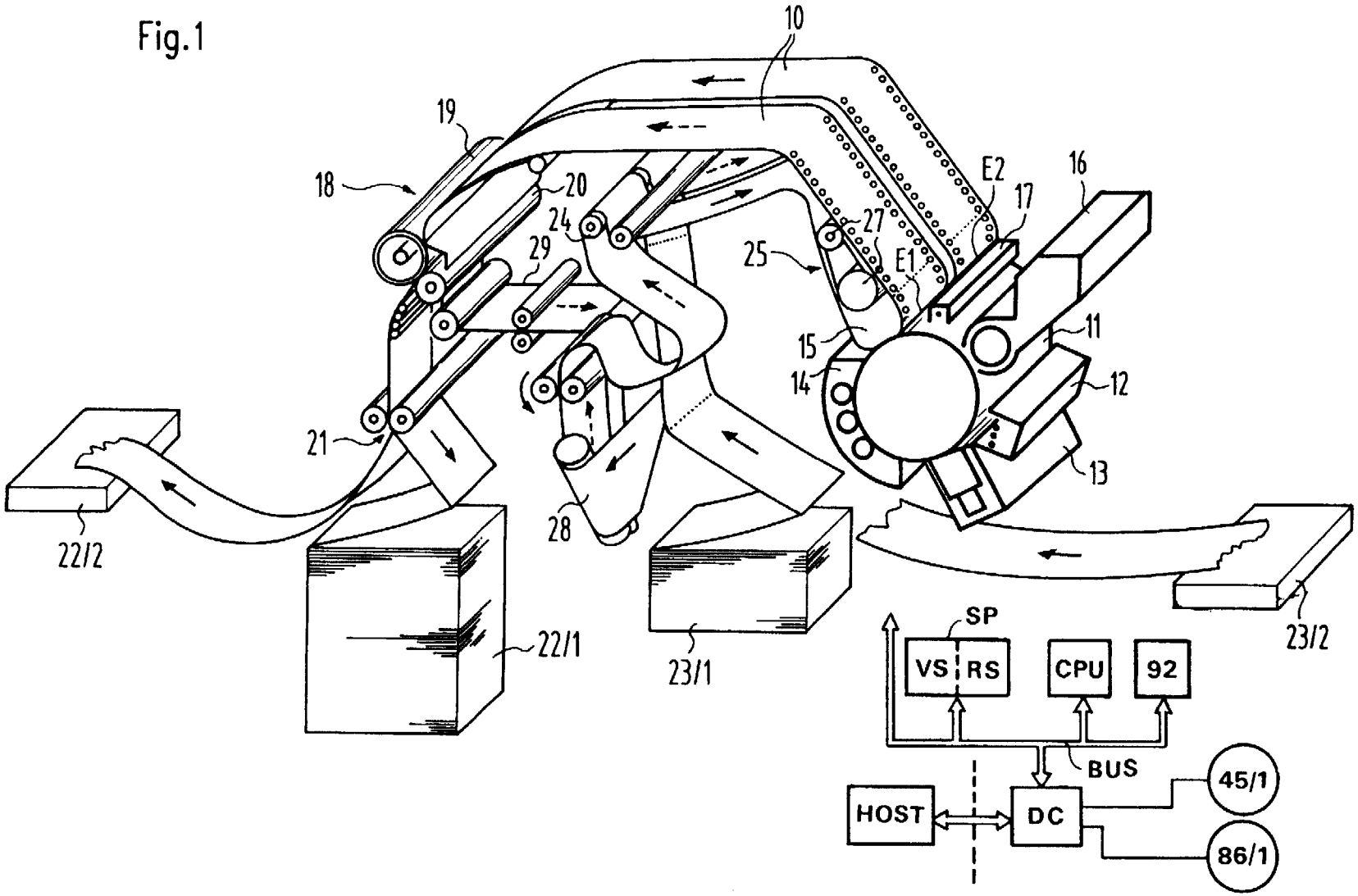
FIG. 1 is a schematic illustration of an electrographic printer device for printing web-shaped recording media in duplex mode.

An electrographic printer device for printing web-shaped recording media 10 differing in web width contains an electromotively driven photoconductive drum as an intermediate carrier 11. However, a web-shaped intermediate carrier, for example and OPC tape or a magneto-styli arrangement as disclosed, for example, by European Patent Document EP-B1-0 191 521, can also be employed instead of the photoconductive drum. The various units for the electrophotographic process are grouped around the intermediate carrier 11. These are, essentially: a charging means 12 in the form of a charging corotron for charging the intermediate carrier 11; a character generator 13 with a light-emitting diode comb for character-dependent exposure of the intermediate carrier 11 that extends over the entire usable width of the intermediate carrier 11; a developer station 14 for inking the character-dependent charge image on the intermediate carrier 11 with the assistance of a one-component or two-component developer mix; a transfer printing station 15 that extends over the width of the intermediate carrier 11 and with which the toner images are transferred onto the recording medium 10. A cleaning station 16 with cleaning brushes integrated therein with appertaining extraction means as well as a discharge means 17 is provided for removing the residual toner after the development step and after the transfer printing step. The intermediate carrier 11 is electromotively driven and moves in the arrow direction during print mode.

The printer device further contains a fixing station 18 following downstream from the transfer printing station 15 in the conveying direction of the recording medium, this fixing station 18 being fashioned as a thermal pressure fixing station with a heated fixing drum 19 having an appertaining pressure roller 20, as well as a delivery means 21 with guide rollers following the fixing station for supplying the recording medium 10 to an internal stacker means 22/1 or to an external stacker or other after-processing means 22/2 arranged outside the printer device. Instead of the illustrated fixing station, other fixing stations, for example with a heated or unheated admission saddle, or a cold fixing station are also possible. The web-shaped recording medium 10, for example, is fabricated as pre-folded continuous stock provided with margin perforations and is supplied to the transfer printing station 15 via delivery rollers 24 of a pivotable paper separator means proceeding from an internal 23/1 or external 23/2 supply region. However, it is also possible to supply a recording medium without margin perforations via a roller delivery arrangement.

The conveying of the recording medium thereby preferably ensues via a conveyor means 25 allocated to the transfer printing station 15 and having the form of conveyor belts provided with pins that, conducted over drive shafts 27, engage into the margin perforations of the recording medium 10. When a recording medium free of conveying holes is employed, it is at the command of a person skilled in the art to convey the recording medium with, for example, friction, controlled by a control arrangement that senses synchronization marks. Further, a turn-over means 28, whose structure and function shall be explained later and via which the recording medium already printed on the front side is turned over for printing the back side and is resupplied to the transfer printing station 15, is arranged in the housing region of the printer device, namely in a receptacle region for the internal supply stack 23/1.

The turn-over means 28 is in communication with the fixing station via a return channel 29.

The printer device is controlled via a printer controller, schematically shown in FIG. 1 here, comprising a central unit CPU, a page memory SP that is divided into memory areas that are page-dependent, as well as comprising a data control unit DC. All units of the controller are connected to one another and to the units of the printer device via a bus system.

The electrographic printer device is suitable for printing recording media with different tape widths. To this end, the intermediate carrier 11 (photoconductive drum) comprises a usable width that corresponds to the greatest possible recording medium width (for example, a DIN A3 format broadside). This width corresponds to twice the DIN A4 web width. It is thus possible to arrange two narrower recording medium webs with DIN A4 format longitudinally side-by-side in the region of the transfer printing station 15. The fixing station 18 and the other electrophotographic units such as a developer station 14, a character generator 13, a cleaning station 16 are designed in conformity with this usable width.

A matching of the width of the character generator 13 to different recording medium widths requires no mechanical modification at the character generator when, as in this case, an LED character generator comprising a plurality of LEDs arranged in rows is employed. A matching of the character generator to the width of the recording medium employed ensues by electronic selection.

The conveyor means can be fashioned to be width-adjustable for matching the conveyor means 25 to different recording medium widths.

This can be achieved, for example, in that the drive wheels that carry the conveyor belts (nubbed belts) that engage into the margin perforations of the recording medium are displaceably seated on polygonal shafts.

When two narrow recording media are arranged side-by-side and conveyed in the region of the transfer printing station 15, it normally suffices to provide a conveyor means only for the margin perforations lying respectively at the outside. Given a corresponding design, it is therefore possible to employ the same conveyor belts for the wide recording medium and for the two narrower recording media without having to adjust these conveyor belts. If it nonetheless becomes necessary to guide the recording media at both sides, then centrally separated conveyor elements that engage into the margin perforations of the recording media can be provided for operation with two narrow recording media arranged side-by-side. So that these conveyor elements do not get in the way during operation with only one wide recording medium, they can be arranged to be pluggable and unpluggable in the conveyor path or so as to be pivoted out or, on the other hand, it is possible to provide the drive wheels 27 of the conveyor means 25 with retractable and extensible pins or, respectively, nubs.

The turn-over means 28 coupled to the fixing station 18 via the return channel 29 for narrow recording media has two jobs: First, it serves for the lateral displacement of the recording medium web so that a parallel guidance is possible in the region of the transfer printing station 15; second, for front/back side reversal of the recording medium. It can be fashioned to be switchable between configurations dependent on the operating mode.

The inventive printer device enables the greatest variety of operating modes without modify the hardware structure:

For the two-sided printing operation of a narrow recording medium 10 in duplex mode, as shown in FIG. 1, the narrow, for example DIN A4-wide recording medium 10—proceeding from the supply region 23 —is supplied via the delivery rollers 24 to the transfer printing station 15, and a transfer printing sub-region E1 at its top side is printed with a front side toner image. The front side of the recording medium 10 is thereby identified by solid-line conveying arrows, the back side by broke-line conveying arrows. The recording medium with the loose, electrostatically adhering front side toner image is then supplied to the fixing station 18 and the front side toner image is fixed thereat. Subsequently, further conveying of the recording medium ensues via the return channel 29 to the turn-over means 28, whose deflection contour is positioned in a turn-over position. The recording medium is turned over by 180° with respect to its front and back side in the turn-over means 28 and is resupplied to the transfer printing means 15 via the delivery rollers 24 so that its back side can be provided with a back side toner image in the transfer printing sub-region E2. Subsequently, the recording medium is resupplied to the fixing station 18 and the back side toner image is fixed, and, subsequently, the recording medium that is printed on both sides is deposited in the stacker means 22/1 or output for paper after-processing in a cutter means 22/2 or the like.

Since the front side and back side toner images are generated at different points in time and are transferred onto the single, narrow recording medium, a corresponding data editing via the printer controller is necessary. To this end, the page memory SP contains memory areas VS for storing the front side image data and memory areas RS for storing the back side image data. The data editing thereby ensues via the data control means DC, whereby the data are supplied via an interface to the data control means DC proceeding from a data source (HOST), which is for example an external data store. The data of the individual pages to be printed are thereby deposited in the page memory SP, namely into the corresponding memory areas that are separated according to front side VS and back side RS. The fetching of the data then ensues under time control, so that the desired front side/back side allocation of the toner images on the recording medium is achieved.

For single-sided printing of a single, wide recording medium 10/3, for example in the format A3 broadside or narrower as well, corresponding to the illustration of FIG. 2, the recording medium 10, proceeding from the supply regions (supply stack) 23/1 or 23/2, is conducted in a conventional way via the delivery rollers 24 (paper separator) to the transfer printing station 15, is provided with toner images thereat and fixed in the fixing station 18 and is subsequently deposited in the internal or external stacker means 22/1 or 22/2. The conveying thereby ensues via the conveyor means 25 that engages into the margin perforations of the recording medium, whereby the width of the conveyor means 25 is set corresponding to the width of the recording medium.

Such a wide recording medium enables, for example, printing with toner images arranged DIN A3 broadside or, on the other hand, with two toner images DIN A4 arranged side-by-side.

Figure 3:
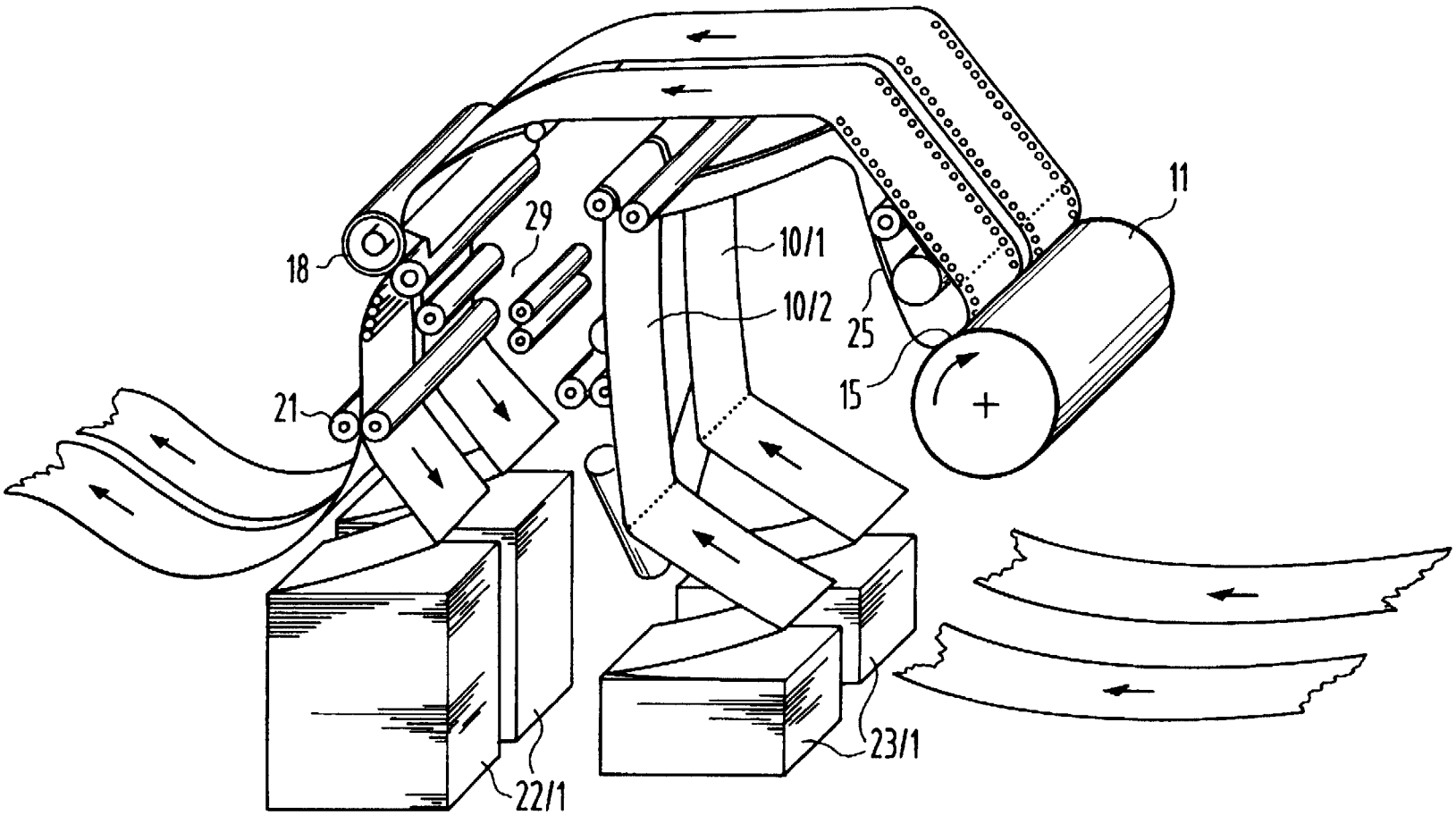
FIG. 3 is a schematic illustration of the same electrographic printer device in simplex mode for the parallel printing of two narrow recording media.

For printing two individual, narrow recording media 10/1,10/2 arranged side-by-side, for example with a width DIN A4, the two recording media 10/1,10/2 are conducted parallel through the printer device with the transfer printing station 15 and the fixing station 18, corresponding to the illustration of FIG. 3. The conveying of the recording medium webs 10/1 and 10/2 ensues via the correspondingly set conveyor means 25. In the illustrated exemplary embodiment, the recording medium webs 10/1 and 10/2 are conveyed at both sides via their margin perforations. As already set forth, the middle conveyor elements can be brought into engagement for this purpose with the inner margin perforations of the recording medium webs 10/1 and 10/2 by extending corresponding pins. It is also possible to fashion these inner conveyor elements as elements that can be put in place as needed. For conveying the recording medium webs 10/1 and 10/2 in the region of the transfer printing station, it is also fundamentally possible to employ only the outer conveyor elements and to thus convey the recording medium webs at one side.

Turn-Over Means

Figure 2:
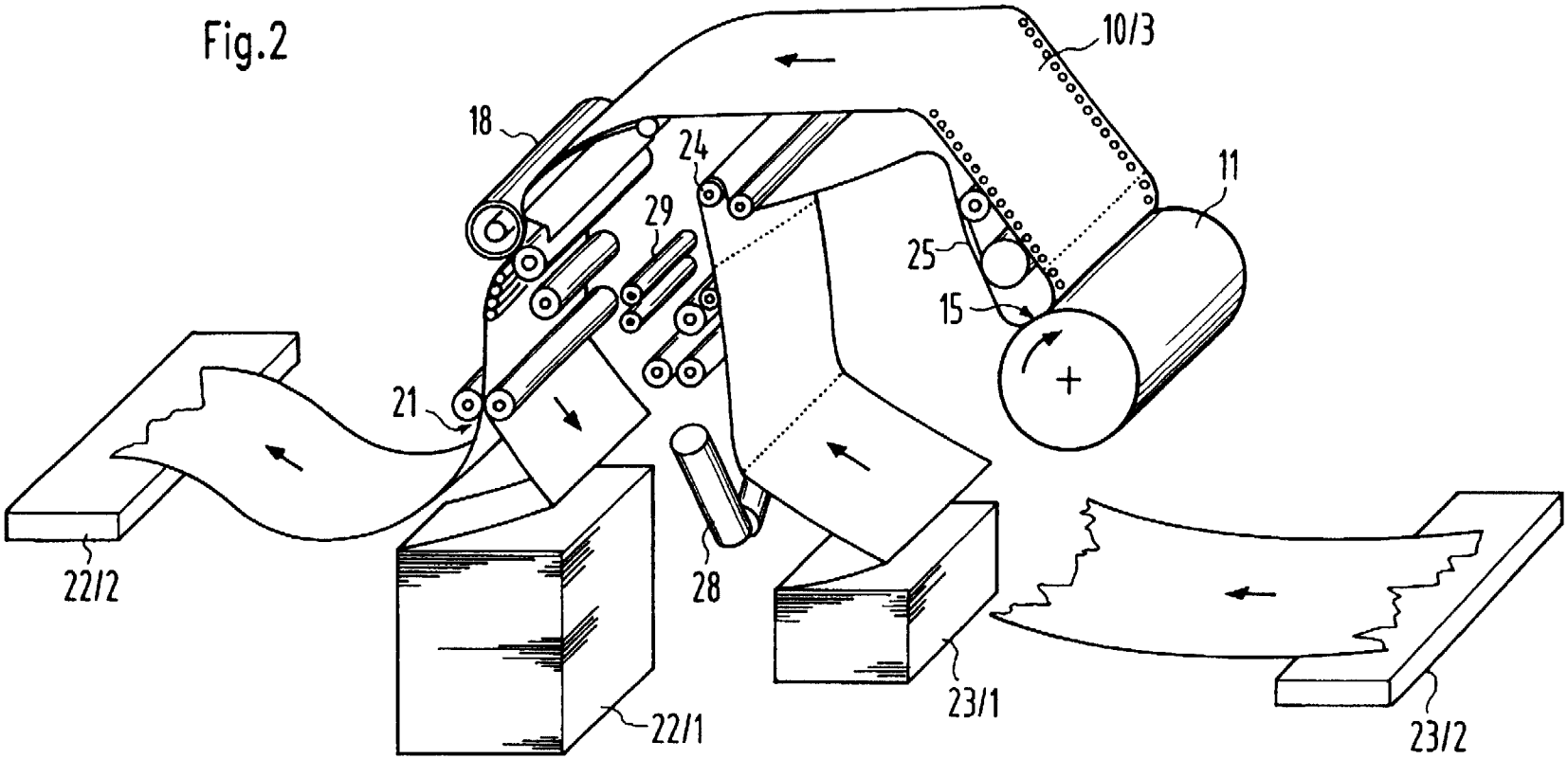
FIG. 2 is a schematic illustration of the same electrographic printer device in simplex mode for printing a single, wide recording medium.
Figure 4:
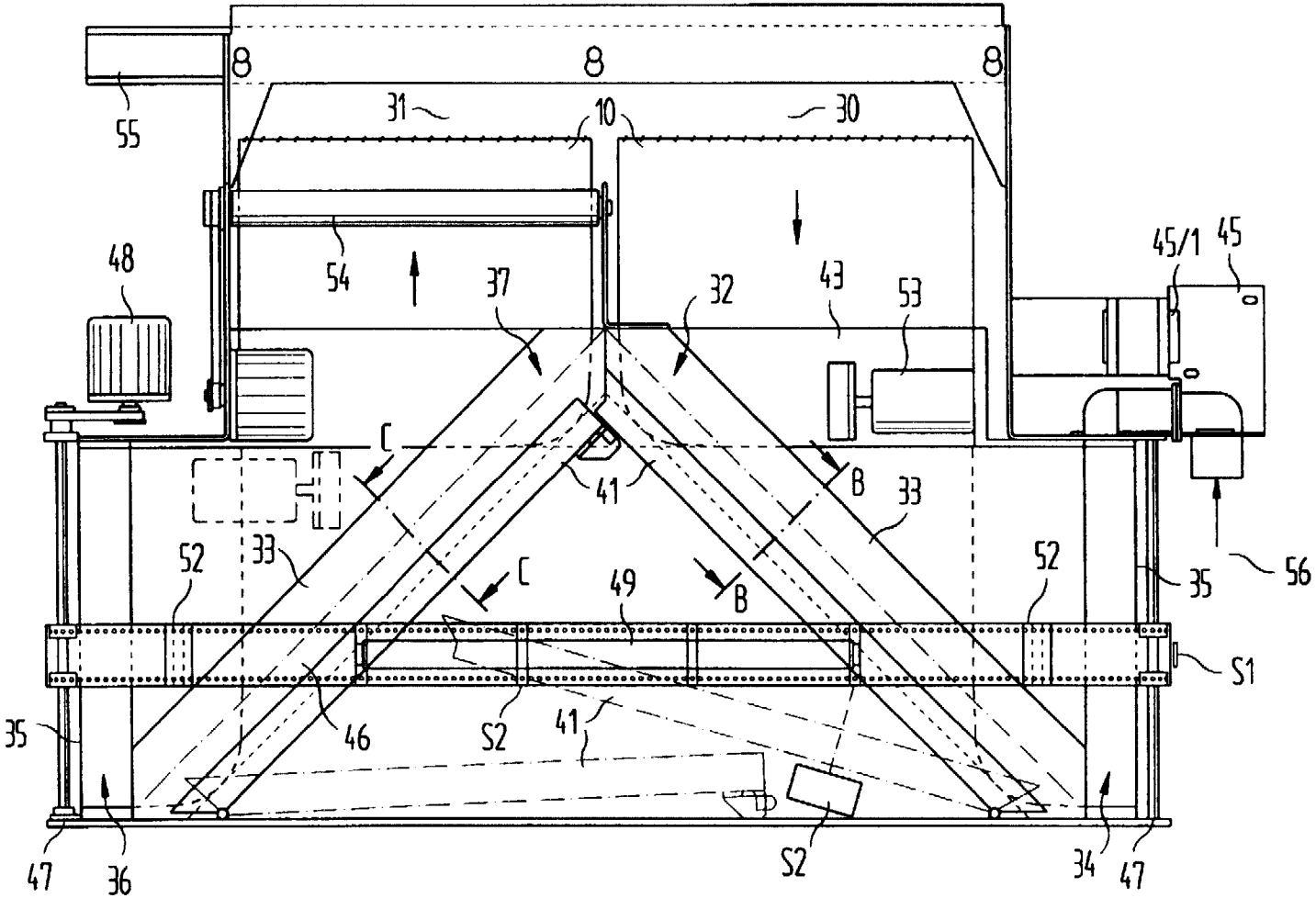
FIG. 4 is a schematic illustration of a turn-over means arranged in the electrographic printer device; medium.

The turn-over means 28 (as shown in FIG. 4) essentially contains four deflection elements arranged like the letter W via which the narrow recording medium 10—proceeding from a paper admission channel 30 coupled to the return channel 29 (FIG. 1)—is conducted to a paper output channel 31 that in turn supplies the recording medium 10 to the delivery rollers 24 (FIG. 2). Paper admission channel 30 and paper output channel 31 are thereby arranged next to one another in one plane.

The recording medium 10 that is supplied to the paper admission channel 30 via the return channel 29 is first conducted over a first oblique deflection means 32 that laterally deflects the recording medium. This is composed of a hollow deflection rod 33 or drum arranged at about 45° relative to the paper running direction. The first oblique deflection element 32 is followed in paper conveying direction by a first reversing means 34 having a deflection element 35 in the form of a hollow profile for returning the recording medium 10 behind the paper channels up into the region of a second reversing means 36 arranged approximately parallel to the first reversing means 34 that again reverses the recording medium 10. This second reversing means likewise comprises a deflection element 35'in the form of a hollow profile. The second reversing means 36 is followed by a second oblique deflection means that steers the recording medium 10 into the paper output channel 31 and that has a hollow deflection rod 33' or drum arranged at about 45° relative to the paper running direction.

Figure 5:
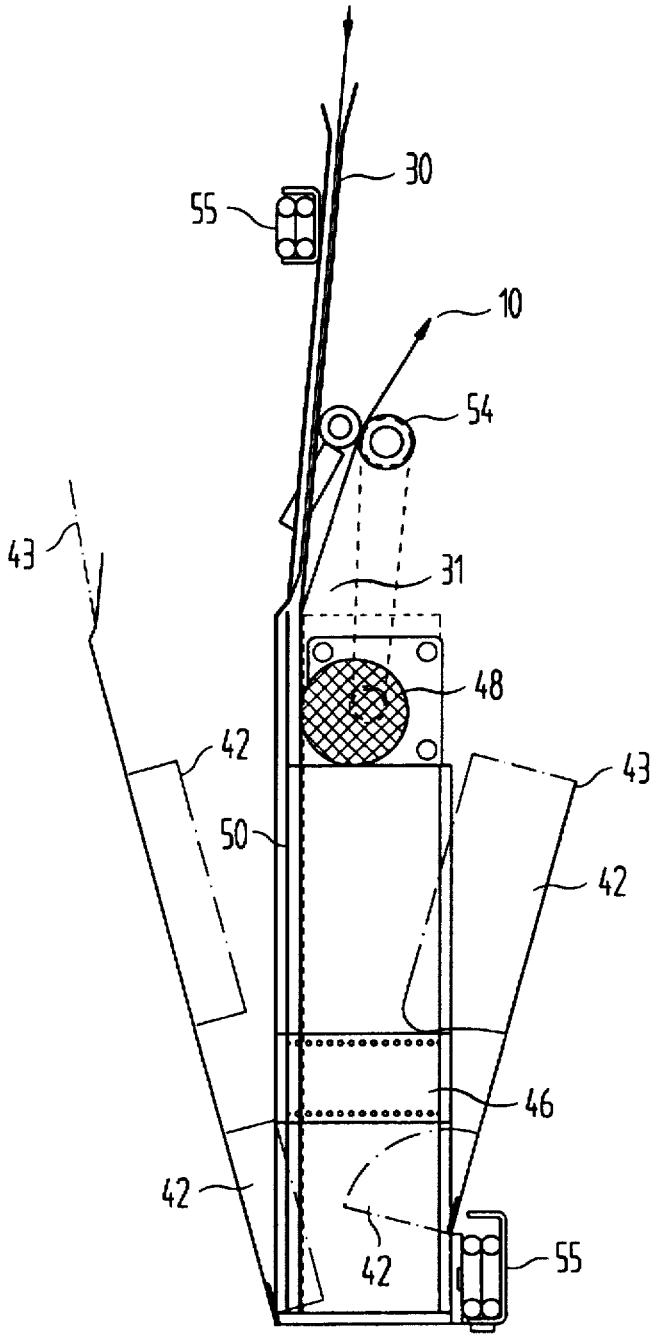
FIG. 5 is a schematic illustration of the turn-over means arranged in the electrographic printer device in a side view.
Figure 6:
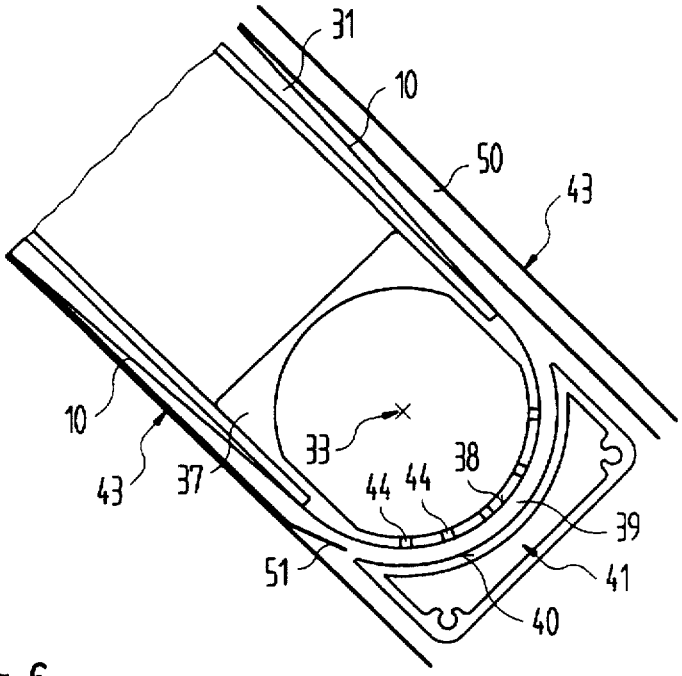
FIG. 6 is a schematic, sectional illustration of the paper guide in the turn-over means along the section line C—C of FIG. 4.
Figure 7:
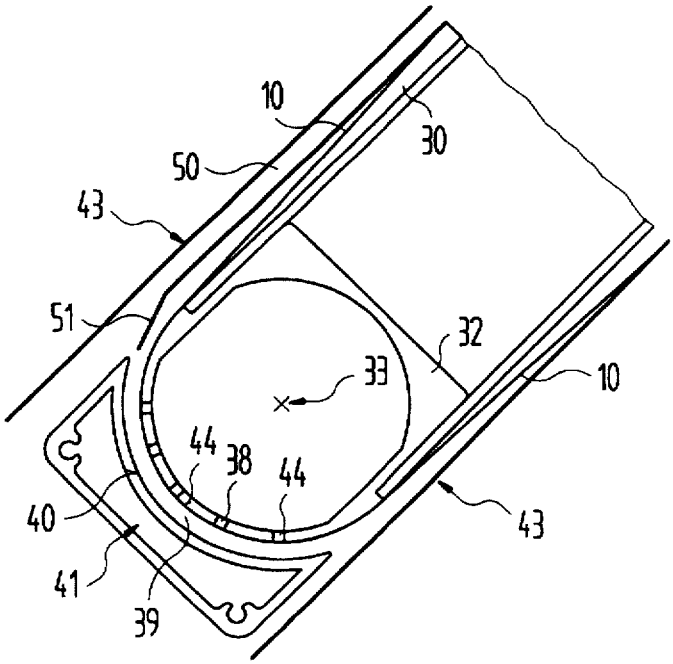
FIG. 7 is a schematic, sectional illustration of the paper guide in the turn-over means along the section line B—B of FIG. 4.

As deflection surfaces 38 (FIGS. 6 and 7), the deflection rods 33 and deflection elements 35 comprise wear-resistant, polished surfaces that serve as glide surfaces for the recording medium 10 and that are embraced by guide surfaces 40 at a distance that forms a deflection channel 39. The guide surfaces 40 allocated to the deflection rods 33 of the oblique deflection devices 32 and 37 are part of flaps 41 of hollow profiles that are arranged in a way to be pivoted out. They are shown in the operating position (solid line) and in the pivoted-out position (broken lines) in FIG. 4. The guide surfaces 40 of the deflection elements 35 are composed of spring sheet steel 42 arranged on housing flaps 43 of the turn-over means at the front side and back side that can be pivoted out. The housing flaps are shown with broken lines in the disengaged position in FIG. 5.

In order to reduce the friction between the glide surfaces and the recording medium in the region of the deflection locations, the deflection surfaces 38 comprise air exit openings 44 (FIGS. 6 and 7) via which an air cushion between the recording medium and the deflection surfaces can be generated, particularly during threading. The hollow spaces of the deflection rods 33 and the deflection elements 35 are in communication with one another and serve as air supply channels. A connector assembly 45 arranged in the receptacle region for the turn-over means in the apparatus can be coupled to the deflection element 35 at the right side for the controlled delivery of fan air via a blower 56. It also contains a plug 45/1 for the electrical connection. This plug can contain a switch via which the correct connection of the turn-over means and, thus, the presence thereof are sensed and reported to the device controller DC in the form of electrical signals.

The turn-over means also contains a threading device for the recording medium 10 with a motor-driven gripper element conducted around the reversing means 34 and 36 that comprises gripper means for the start of the recording medium, whereby—for threading into the turn-over means—the start of the recording medium is grasped in the region of the first oblique deflection element 32 and is conveyed over the reversing means 34 and 36 and the second oblique deflection means 37 into the region of the paper output channel 31.

In the illustrated exemplary embodiment, the gripper element is composed of a margin-perforated conveyor belt 46 that is conducted around the reversing means 34,36 over guide shafts 47. It is driven via a motor 48. A friction coat 49 (or friction element) of foamed material or silicone is arranged on the inside of the conveyor belt 46. Its length is dimensioned such that—given the operating status of the turn-over means shown in FIG. 4 wherein the friction element 49 is located between the oblique deflection devices 32,37—the friction element 49 is disengaged from the recording medium 10.

A recording medium circulation channel 50 with allocated shunts 51 for admitting and discharging the recording medium 10 in the region of the oblique deflection devices 32,37 proceeds around the reversing devices 34,36. Together with the deflection channels 39, a through guide channel for the recording medium 10 basically derives around the deflection elements 33,35 from the paper admission channel 30 to the paper output channel 31. The conveyor belt 46 dips into the channel sections of the recording medium circulation channel that lie between the reversing devices 34,36 and is guided thereat. The channel walls facing toward the friction coat 49 comprise roller elements 52 (FIG. 4) in the region of the conveyor belt 46 for reducing the friction between the recording medium 10 and the wall surface. The recording medium 10 is clamped between the roller elements 52 and the friction coat 49 and is thus reliably conveyed by the friction coat 49.

Figure 8:
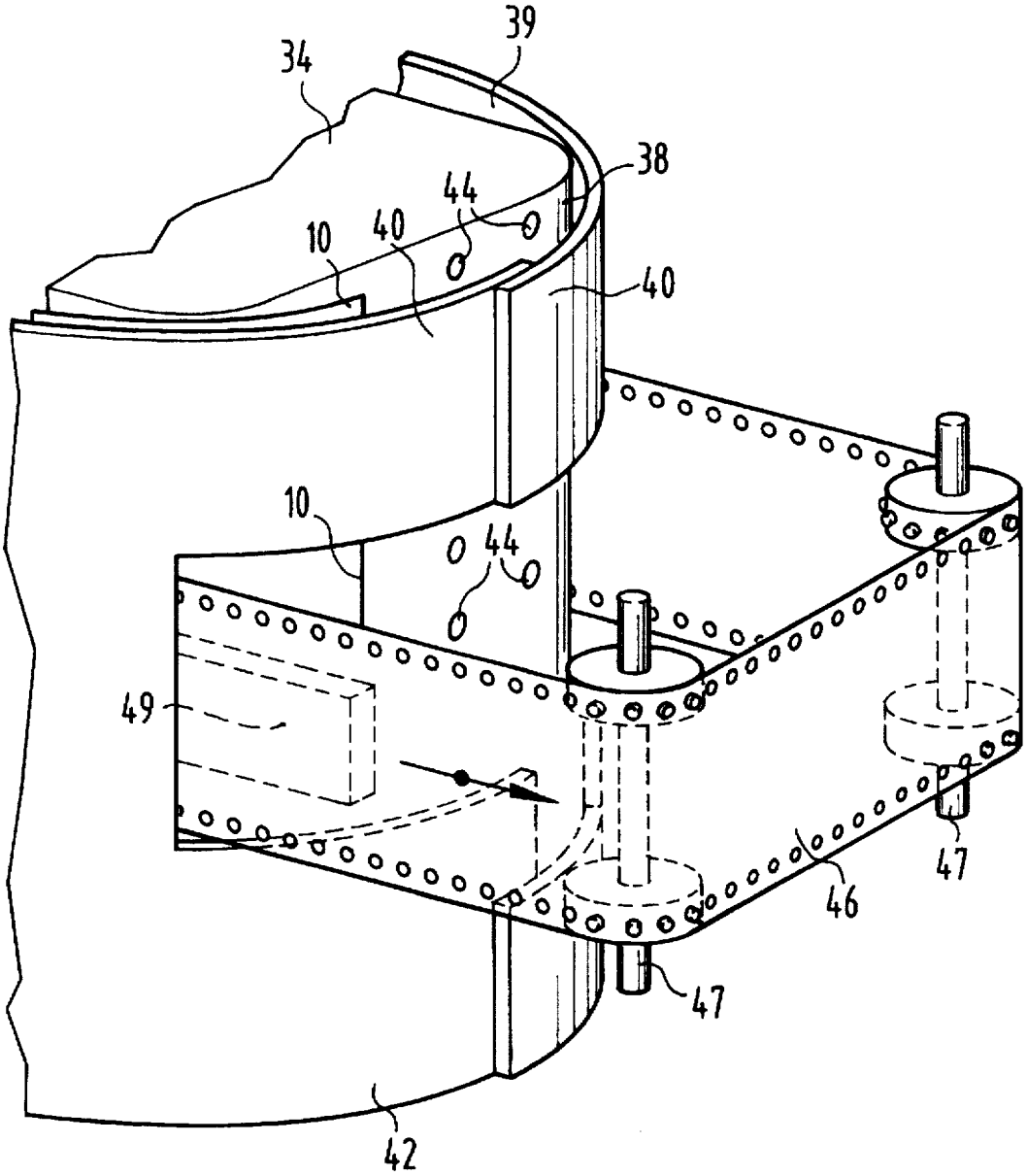
FIG. 8 is a schematic illustration of the paper guide in the region of the lateral reversing devices.

In the region of the reversing means 34,36, the conveyor belt 46 is conducted over a conveying path (FIG. 8) that proceeds outside the deflection channel 39 as part of the recording medium circulating channel 50 and that is longer than the conveying path of the start of the recording medium through the deflection channel 39. The position of the recording medium 10 thus changes in leading fashion relative to the friction coat 49 when circulating around the reversing means 34,36. At the end of the threading procedure, it is thus possible to push the start of the recording medium over the back end of the friction coat 49 far into the paper output channel, where it is seized by paper conveying elements. These paper conveying elements 53 can be composed of pivotable friction wheels or beater elements or tractors with conveyor lamellae. They are arranged in the region of the oblique deflection devices 32,37 in the paper admission channel 30 and in the paper outlet channel 31, namely such that they engage at that side of the recording medium 10 that is free of toner images. Downstream of the second oblique deflection device 37, further, an additional motor-driven recording medium conveyor means is provided in the form of paper transport rollers 54, this serving the purpose of supplying the recording medium 10 to the transfer printing station via the rollers 24.

The turn-over means is controlled via a microprocessor-controlled threading control arrangement that can be part of the device controller DC. It contains a central controller with a microprocessor. The input side thereof is in communication with an optical sensor S2 that is arranged under the first oblique deflection device 32 and that senses the start of the recording medium in the region of the first oblique deflection device 32, and is also in communication with a sensor S1 arranged in the region of the first reversing means 34 that can be fashioned as a Hall sensor and that senses the position of the friction element 49 (friction coat) via a magnet element. At its output side, the threading control arrangement is coupled to the blower 56 for generating the fan air, the drives for the paper conveyor elements 53 and the paper transport rollers 54 and with the conveyor belt drive 48. For threading, the threading control arrangement acquires the start of the recording medium in the region of the first oblique deflection means 32 via the sensor S2, activates the conveyor belt drive 48 dependent thereon and, dependent on the position signal of the sensor S1 after threading the start of the recording medium into the paper output channel 31, positions the friction coat 49 in a quiescent position in which it is disengaged from the recording medium 10.

Figure 9:
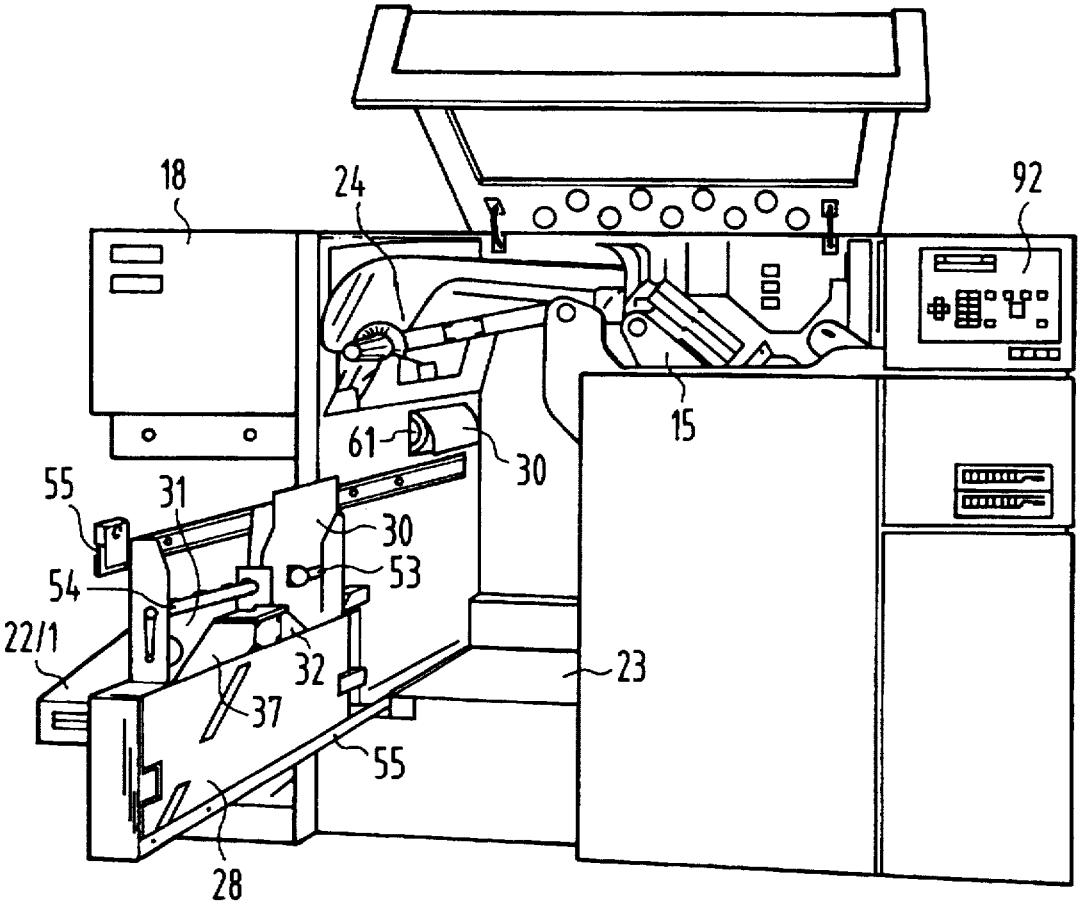
FIG. 9 is a schematic illustration of the turn-over means in service position.
Figure 10:
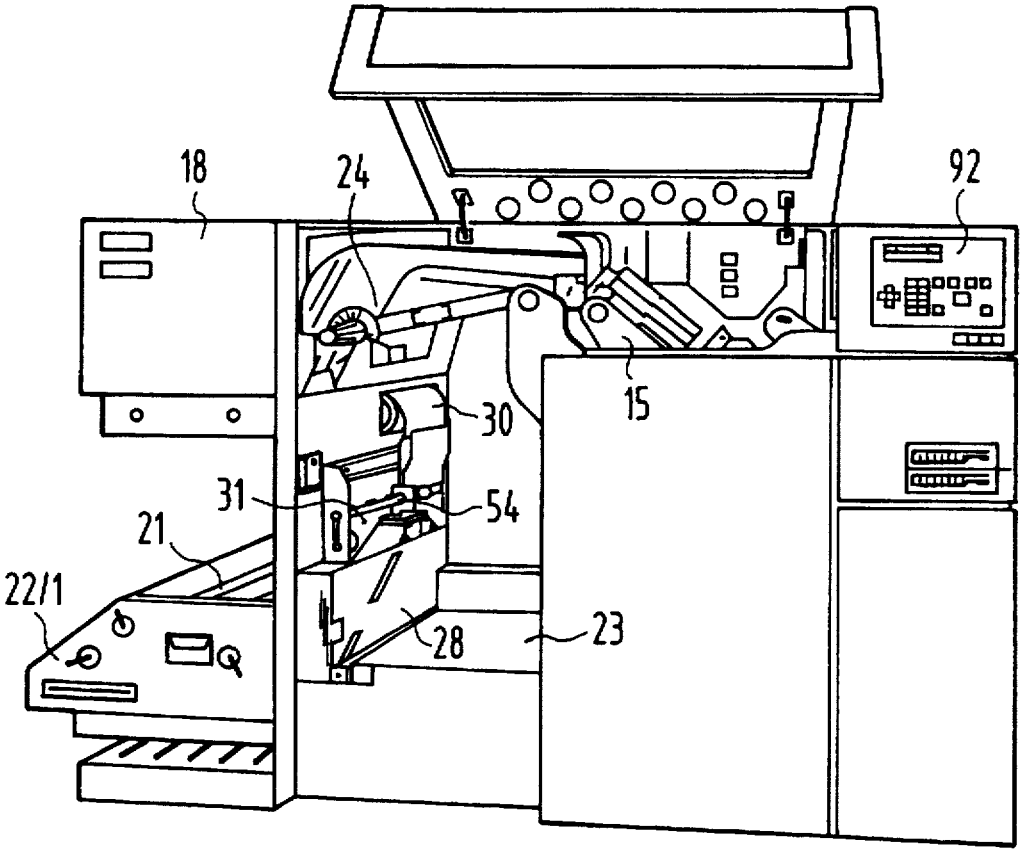
FIG. 10 is a schematic illustration of the turn-over means in operating position.
Figure 11:
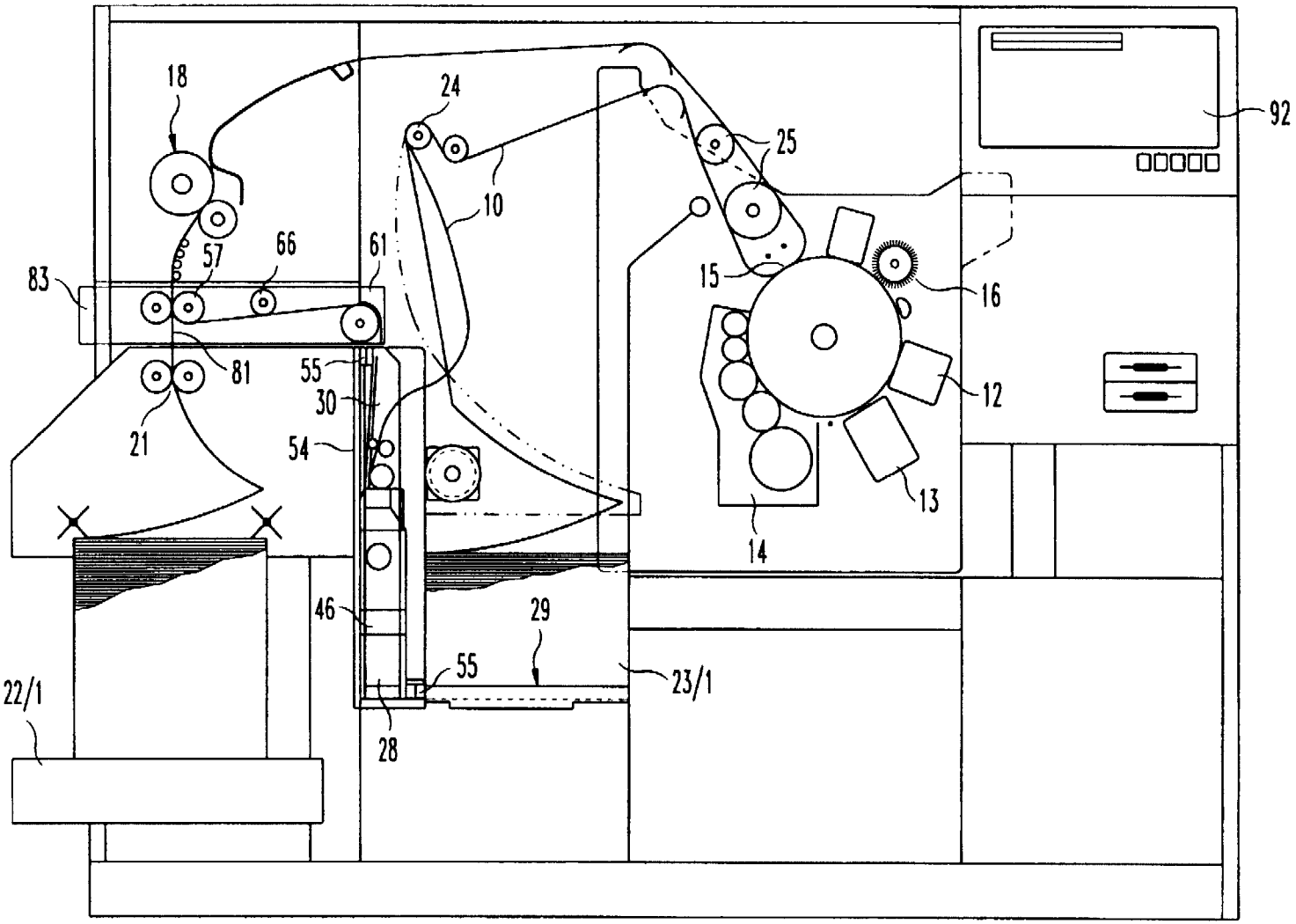
FIG. 11 is a schematic, sectional view of the printer device.

The turn-over means is fashioned as an independent, torsionally stiff structural unit in the form of a module and is so as to be seated extensible on telescoping rails 55 in the device in the receptacle region 23 for the internal supply stack 23/1 (FIGS. 9,10). All deflection elements are thus freely accessible given paper running disturbances and during service.

Function of the Turn-Over Means

For automatic threading of the recording medium through the turn-over means, the blower 56 for generating the fan air, the drives for the paper conveyor elements 53 and the paper transport rollers 54 are activated via the threading control arrangement. The friction coat 49 is situated in the quiescent position between the oblique deflection elements 32,37 shown in FIG. 4. The start of the tape entering via the paper admission channel 30 is deflected in the deflection channel 39 of the first oblique deflection means 32 and is recognized via the sensor S2. The conveyor belt 46 is thereby started. It seizes the start of the tape via the friction coat 49 and conveys it around the first reversing means 34. The start of the recording medium thereby somewhat leads the friction coat 49. Subsequently, the start of the recording medium runs around the second reversing means 36 and thereby again somewhat leads the friction coat 49. The start of the recording medium is then pushed by the back end of the friction coat 49 over the shunt 51 and through the second oblique deflection means 37 into the region of the paper conveyor element 53, is seized by the latter and conveyed into the region of the paper transport rollers 54 (FIG. 4) and continues from the latter to the transfer printing station. The threading procedure has thus been ended and the friction coat is again in the quiescent position (FIG. 4) disengaged from the recording medium.

Return Means

Figure 12:
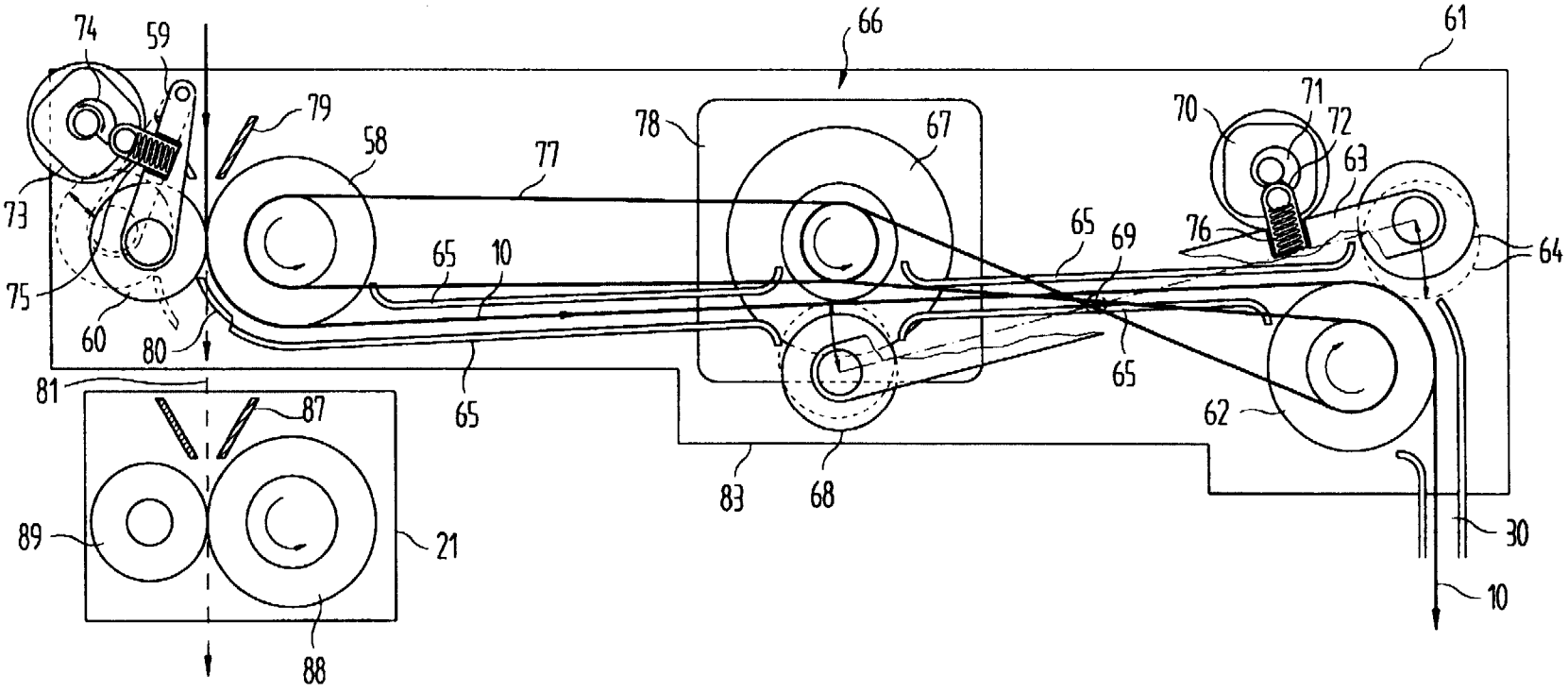
FIG. 12 is a schematic illustration of the return means to the turn-over means.

A return means (FIG. 12) is arranged in the return channel 29, this serving the purpose of returning the recording medium to the turn-over means 28 from the fixing station 18 after the front side has been printed. The return means contains a motor-driven traction roller pair 57 at the input side with a motor-driven transport roller 58 and a pressure roller 60 that can be swivelled in and out via a lever 59, further contains a traction roller pair 61 at the output side with a motor-driven transport roller 62 and a pressure roller 64 seated on a pivoted lever 63 that can be swivelled in and out. A connecting channel 65 composed of upper and lower baffle plates is arranged between the traction roller pair 57 of the input side and the traction roller pair 61 of the output side, the channel width of this connecting channel 65 being dimensioned such that a buckling of the recording medium in the channel is largely prevented. To this end, it comprises a clearance of no more than 15 mm. What is thereby achieved is that the recording medium does not buckle while the start of the recording medium is being pushed through the connecting channel 65. Since the distance between the traction roller pair 57 of the input side and the traction roller pair 61 of the output side can be so great that, despite the narrow connecting channel, there is a risk that the recording medium will buckle given employment of extremely light-weight papers with, for example, a paper weight of 60 grams per square meter, a conveying auxiliary composed of a further motor-driven traction roller pair 66 having a motor-driven transport roller 67 and a pressure roller that can be swivelled in and out is arranged about in the middle relative to the connecting channel between the traction roller pair 57 of the input side and the traction roller pair 61 of the output side. Compared to the pressure roller 64, the pressure roller 68 is seated at the opposite side of the pivoted lever 63. The pivoted lever 63 can be swivelled around a rotational axis 69, namely with the assistance of a motor operator 70 that engages at the lever 63 via cam 71 at a projection 72 with compression spring element 76 arranged therein. The pivoted lever 59 of the pressure roller 60 of the traction roller pair 57 of the input side is also coupled to a motor operator 73 that acts on the lever 59 via a cam 74 at a projection 75 with appertaining compression spring 76.

The transport rollers 58,67 and 62, composed, for example, of rubber or silicone, are coupled via belt 77 to a central drive motor 78. In order to be able to reliably supply the start of the recording medium to the traction roller pair 57, the traction roller pair 57 comprises a centering means in the form of a centering funnel 79. However, guide plates or the like can also be employed.

The recording media 10,10/1,10/2,10/3 can also be composed of pre-folded continuous stock wherein the form-fold spacings have the greatest variety of lengths. These folds intensify the risk of buckling during the pushing invent inside the connecting channel 65 since the paper web has hardly any buckling stability in the folded region. The distance between two traction roller pairs, for example the traction roller pairs 57 and 66 or, respectively, 66 and 61 should therefore not fall below the minimum length of the spacing of the folds of the pre-folded recording medium 10 that is employed. Pre-folded recording media having a minimum fold spacing of, for example, 6 inches are known in continuous stock printers.

A shunt of the output side in the form of a deflection plate 80 pivotably coupled to the lever 59 is also allocated to the traction roller pair 57 of the input side. When the pressure roller 60 is pivoted out (shown with broken lines), a through channel for the recording medium that discharges into an output channel 81 to the delivery means 21 for the internal stacker means 22/1 opens between pressure roller 60 and transport roller 58.

Figure 13:
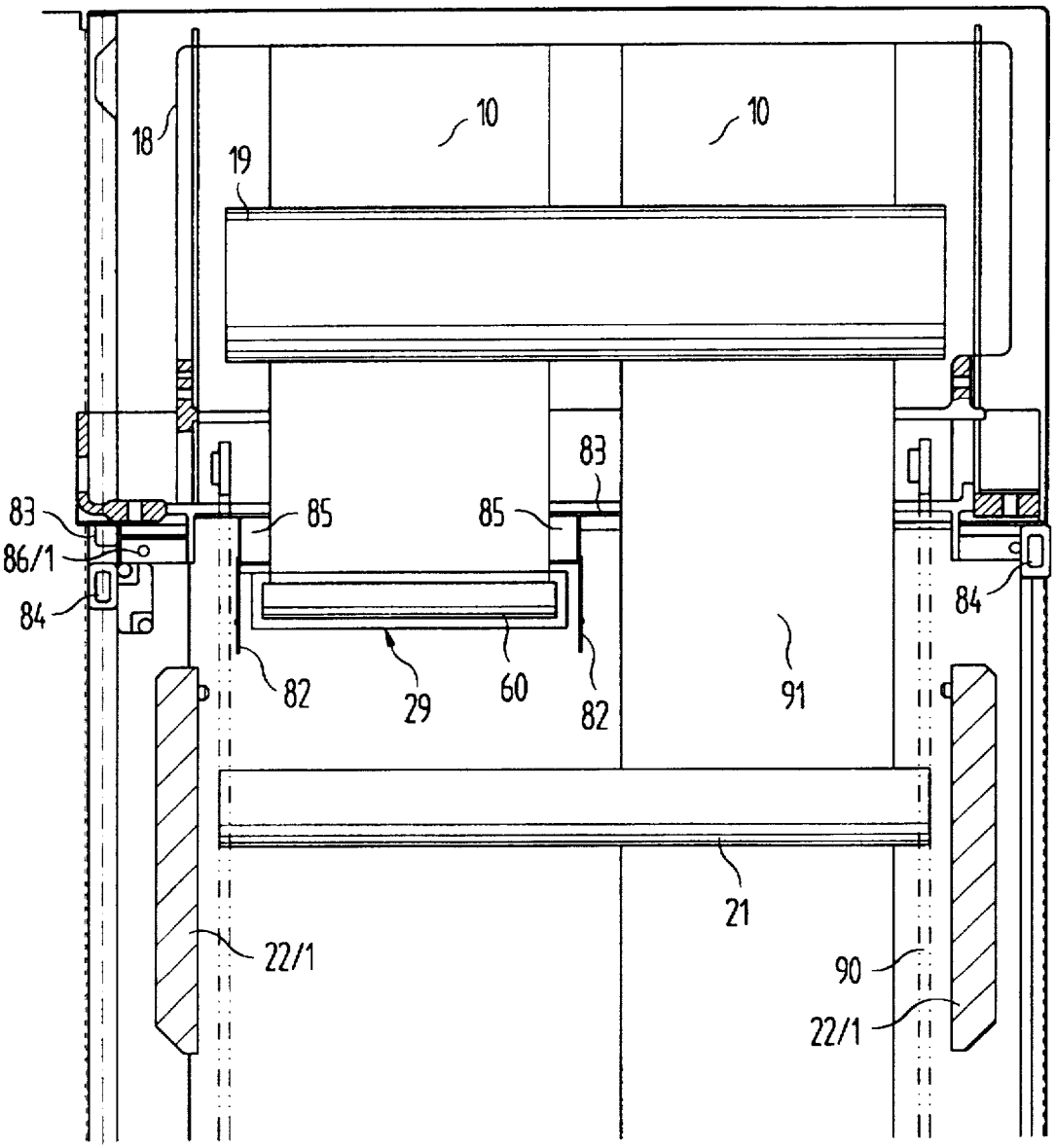
FIG. 13 is a schematic illustration of the return means to the turn-over means from the front.
Figure 14:
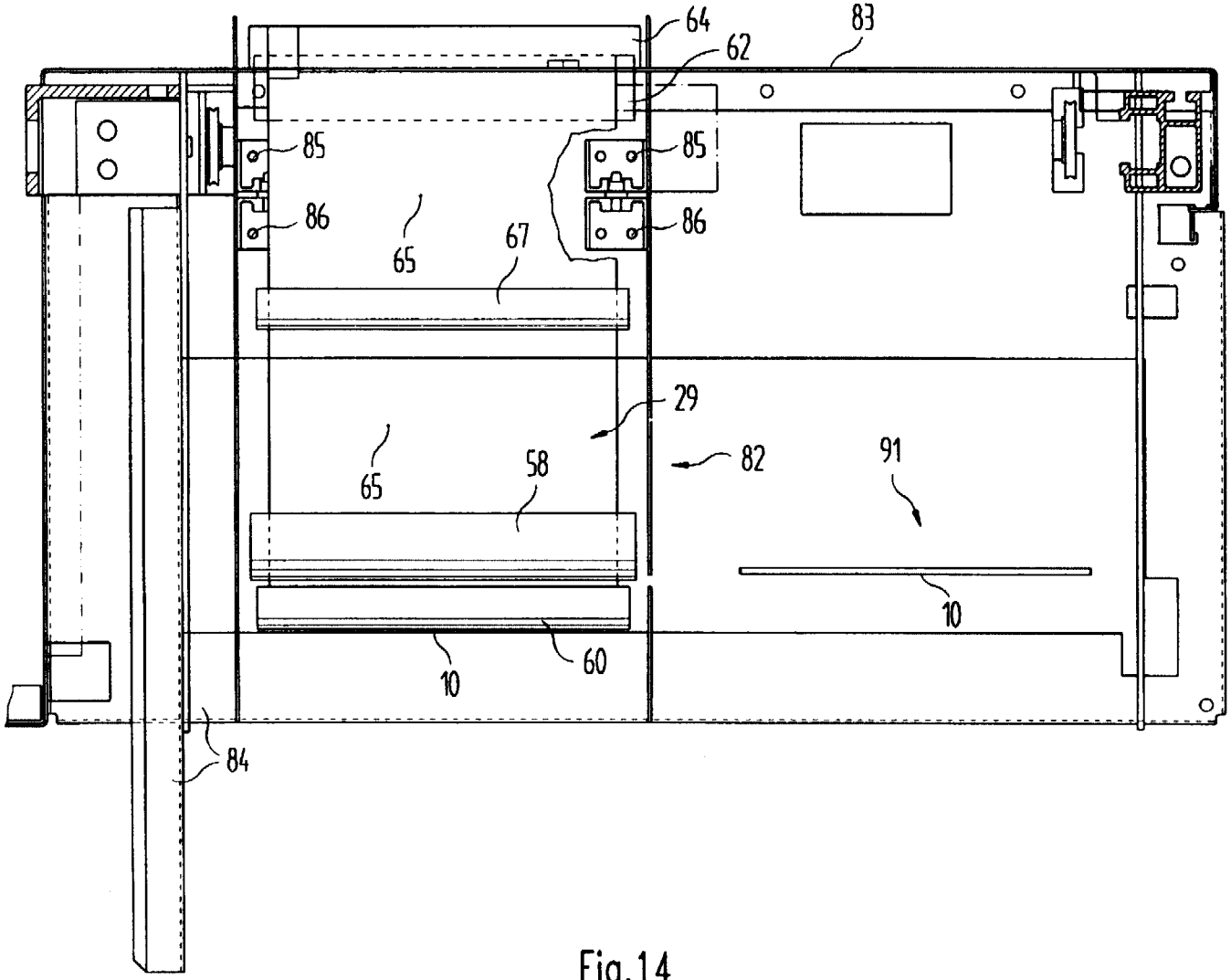
FIG. 14 is a schematic illustration of the return means to the turn-over means from above.

The pressing power of the pressure rollers 60,64 and 68 of the traction roller pairs is variable dependent on the position of the cams 71 and 74. The frictional force on the recording medium 10 located between transport roller and pressure roller thus varies correspondingly. The delivery means is fashioned as an independent structural unit in the form of an interchangeable return module. To this end,the traction rollers 57,66 and 61 together with the appertaining connecting channel 65 are secured between carriers 82 of a module housing 83. The module housing 83 is in turn engaged via corresponding guide elements into telescoping rails 84 that are secured in a receptacle region for the module under the fixing station (FIG. 13). The return module can be pulled from the receptacle region via these rails 84 and can thus be replaced or, respectively, removed. A centering means is also allocated to the return means in order to center the return module in working position in its inserted condition (FIG. 14). In the illustrated exemplary embodiment, the centering means is composed of two centering guides 85 secured to the printer frame into which centering pins 86 secured to the module housing 83 engage. The centering devices can also be fashioned such that the electrical connections for the central drive motor and other electrical components are simultaneously produced by coupling the centering pins to the centering guides. However, other, separate plug-type connections 86/1 (FIG. 13) can also be present. This plug can contain a switch via which the correct connection of the centering means and, thus, the presence thereof as well are sense and reported to the device controller DC in the form of electrical signals.

The internal stacker means 22/1 arranged under the receptacle region for the return module comprises a delivery means 21 that is displaceable dependent on the stack height. The delivery means 21 contains a centering funnel 87 as well as a traction roller pair composed of a motor-driven transport roller 88 with appertaining pressure roller 89. The delivery means 21, which is integrated in the upper part of the stacker 22/1 can be raised and lowered via chains 90. With the return module inserted, it is thus possible to position the delivery means 21 with the delivery roller pair in the region of the output channel 81 and, when the printer module is not present, in the recording medium output region of the fixing station 18.

Function of the Return Means

In order to be able to automatically thread the start of the recording medium through the turn-over station in duplex mode, the start of the recording medium is supplied via the centering funnel 79 to the delivery roller pair 57 with the return module inserted. The pressure rollers of the delivery roller pair 57 of the input side, of the middle delivery roller pair 66 and of the delivery roller pair 61 of the output side are swivelled in. The delivery roller pair 57 seizes that start of the recording medium and, with the support of the middle delivery roller pair 66 and of the delivery roller pair 61 of the output side, conveys it into the paper admission channel 30 of the turn-over means 28, where it is seized by the conveyor elements arranged thereat and is threaded through the turn-over means 28. The frictional force, particularly in the region of the delivery rollers 57 of the input side, is thereby dimensioned such by taning the cams 74 that the recording medium does not rip in the region of the fixing station. After being threaded through the turn-over means 28, the start of the recording medium is pushed through the transfer printing station and the back side is thereby simultaneously printed. It then proceeds via the paper output channel 31 of the fixing station 18, into an output channel 91 arranged next to the return channel 29, through the return module into the region of the delivery means 21 of the internal stacker means and is seized by the latter. During printing operation, the pressure rollers 64 and 68 of the delivery rollers of the middle delivery roller pair 66 and of the delivery roller pair 61 of the output side are swivelled away, so that only the drive force of the delivery roller pair 57 of the input sides takes effect. By positioning the cam 74, this is dimensioned such that it does not react onto the paper traction force in the fixing station 18 and negatively affect the paper running therein. In particular, the traction force dare not be so high that a slippage that smears the print image arises when the recording medium passes through the fixing and pressure drum in the fixing station. Independently of the swivelled condition of the pressure roller in the traction roller pair, the transport rollers are constantly driven via the central drive 78. The transport roller 58 of the traction roller pair 57 of the input side engages at the side of the tape-shaped recording medium 10 that is free of print image.

Given a stop in printing during printing mode, the recording medium must be stopped in page-suited fashion by the paper transport and must be restarted in page-suited fashion given a renewed start of printing. Since a retardation distance given every stop of the paper web and an acceleration distance given every start of the paper web are required, the recording medium must be retracted to such an extent preceding the transfer printing location given a stop event that it can be accelerated given a restart and can be synchronized for the transfer printing. This backward conveying following a stop of the paper web is supported by the return unit with respect to the front side web and is supported by the delivery roller pair of the delivery means 21 with respect to the back side web, so that this paper pull-back can be implemented given a relaxed paper web insofar as possible. An overload of the paper transport perforations or, respectively, too great a widening of the transport perforations would result without this pull-back relaxation, which would lead to positioning errors in the print image upon restart. The pull-back roller forces are designed such for the printing mode that the paper web is sure to be conveyed out of the fixing station. Further, the traction roller forces dare not be so high that they take effect through the fixing gap between pressure and fixing drum and thus negatively influence the paper running in the fixing station. Given a reverse conveying following a paper stop, the traction roller pair 88,89 of the height-displaceable delivery means 21 pulls the printed recording medium 10 load-free from the stacker unit 22/1 or from an after-processing loop 22/2. The traction roller pairs of the return means (front side web), however, must pull the recording medium through the return channel 29 and the turn-over means 28. The pull-back resistance is relatively high due to the deflections. So that no slippage of the recording medium occurs in the region of the delivery roller pair 57 of the input side, the pressing power of the pressure roller 60 against the transport roller 58 is increased with the motor operator 73 via the cam 74 and, thus, a corresponding traction of the traction roller pair 57 is achieved that is of such a size that the frictional forces of the paper web can be overcome. The rotational sense of the central drive motor 78 is thereby reversed for the paper pull-back. In order to also raise the paper web traction during the paper pull-back, it is also possible to pivot the pressure rollers 68 and 64 of the traction roller pairs 66 and 61 in with the motor operator 70 and to thus support the pull-back. The traction rollers 66 and 61 are opened and the pressing power in the region of the traction roller pair 57 of the input side is reduced given a renewed run-up of the paper conveying following a printer stop.

As already initially set forth, the printer device also makes it possible to print a wide recording medium 10/3 on only one side in simplex mode or, on the other hand, to simultaneously print two narrow recording media 10/1,10/2 arranged side-by-side in simplex mode. When the fall stack height of the internal stacker means 22/1 is to be preserved for this simplex mode, it is necessary to remove the return module from the printer device. In this case, the delivery means 21 can be moved to a point immediately under the paper output region of the fixing station 18. So that the return module need not be removed given a lower stack height, however, the shunt with the deflection plate 80 that can be swivelled out is arranged in the region of the traction roller pair 57 of the input side. A through channel with appertaining output channel 81 through the return module opens as a result of the deflection plate 80 being swivelled out, and the recording medium or media 10/1,10/2, 10/3 can be supplied through the return module to the delivery means 21. The motion of the deflection plate 80 is meaningfully coupled to the motion of the pressure roller 60. The implementation of the motion can be manually implemented by the printer operator; it can also ensue automatically by motor via the motor operator 73. The return module thus need not be removed every time when switching from duplex mode to simplex mode or vice versa.

The turn-over means 28 arranged in the internal supply region 23/1 limits the storage region available for the acceptance of a supply stack, namely in view of the employable format height (distance between fold of the pre-folded continuous stock). The acceptance surface 23 of the internal supply region is thereby designed such that it can accept a supply stack having the largest possible printing width and a large format height when the turn-over means 28 is removed. When, thus, the printer device is operated in simplex mode with a wide recording medium 10/3 with a large format height, for example 14 inches, it is necessary to remove the turn-over means 28 from the supply region. In simplex mode with a narrow or with two narrow recording media guided parallel, the turn-over means 28 can remain in the supply region if an extremely large format height is not to be printed at the same time. The turn-over means must be removed given format heights of more than about 12 inches.

As explained in conjunction with the structure of the delivery means and the turn-over means, the electrical coupling devices thereof (FIGS. 4,13) comprise switches 45/1 and 86/1 via which the correct connection or, respectively, the presence of these units is sensed and reported to the device controller DC in the form of electrical signals. Other sensor means, for example light barriers or the like, can also be provided instead of switches. It is also possible to sense the presence of these unit via the electrical coupling elements themselves by sampling the terminals via sampling signals proceeding from the device controller DC.

By evaluating the sensor signals via a monitoring means that, for example, can be fashioned in the form of an OR logic element, the electronic device controller DC of the printer automatically recognizes the presence or, respectively, the absence of the delivery means (duplex return) and turn-over units. An independent determination can thus be made via the device controller DC that, with the duplex return removed, the maximally processable paper stack height in the output compartment of the printer can again be enlarged by the structural height of the duplex return and, with the turn-over unit removed, the maximally processable paper format height in the input compartment of the printer can again be enlarged by the structural width of the turn-over unit. This can be displayed in the form of an alphanumerical message in an operating field display 92 at the printer module (FIG. 10).

Whenever one of the two units, duplex return or turn-over unit, is removed from the printer, the electronic device controller DC fully automatically switches all device functions to simplex mode, and the electronic device controller DC fully automatically outputs error messages via the operating field display 92 at the printer module when the user of the printer attempts to access duplex functions.

The described exemplary embodiment of the multi-functional printer device contains a turn-over module with automatic threading means. However, it is also possible to employ a turn-over module having a structure corresponding to the schematic illustrations of FIG. 1 through 3, whereby the recording medium is potentially manually threaded. Given the employment of a recording medium having properties (paper weight, structure, etc.) that do not allow an automatic threading, the turn-over module can be replaced for this operating mode. This is also true of the delivery module.

The term "electrophotographic printer device" is also intended to cover printer or copier devices that employ magnetographic or electrostatic recording methods.

Although other modifications and changes may be suggested by those skilled in the art, it is the intention of the inventors to embody within the patent warranted hereon all changes and modifications as reasonably and properly come within the scope of their contribution to the art.

We claim:

1. A multi-functional printer device for printing web-shaped recording media with different web widths, comprising:

an electrographic printer module comprising a usable width of at least twice a web width of a narrow recording medium, said printer module containing a means for generating toner images and a thermal fixing station with a paper output channel via which the recording media leave said printer module, as well as a delivery channel in order to supply recording media of different web widths from one of an internal and external supply region to said means for generating toner images;

a turn-over module that can be coupled to said paper output channel via a return channel and to the delivery channel, said turn-over module being constructed as an independent structural unit that can be interchangeably secured in the printer module, whereby in a first operating mode of said printer device for two-sided printing of the narrow recording medium, the recording medium for printing the front side passes through said printer module up to said paper output channel of said fixing station proceedings from said supply region and, for printing a back side of said recording medium, is resupplied to said printer module therefrom via said return channel and turned over via said turn-over module, and is output via said paper output channel of said fixing station, and in a second operating mode of said printer device for single-sided printing of one of an individual broad recording medium and parallel printing of a plurality of narrow recording media, the recording medium or media pass through only said printer module, proceeding from said supply region, and are output via said paper output channel.

2. A multi-functional printer device according to claim 1, further comprising:

a return module for the narrow recording medium that contains said return channel and comprises paper conveying elements, said return module being constructed as an independent structural unit that can be interchangeably secured in said printer module.

3. A multi-functional printer device according to claim 2, further comprising:

a receptacle region for said return module arranged under said paper output channel of said fixing station, a delivery means to one of an internal and external deposit means for the recording media that is fashioned displaceable into one of a region of the paper output channel and, with said return module present, into a region of an output channel allocated to said return module.

4. A multi-functional printer device according to claim 1, further comprising:

coupling devices that interchangeably accept one of said turn-over module and said return module in receptacle regions of said printer module, said coupling devices having at least one of mechanical and electrical coupling means for coupling said one of said turn-over module and said return module to said printer module.

5. A multi-functional printer device according to claim 4, wherein said coupling device comprises a displacement means that removably accepts said one of said turn-over module and said return module to said printer module.

6. A multi-functional printer device according to claim 4, wherein said coupling device comprises a centering device that positions said one of said turn-over module and said return module to said printer module in a work position in the appertaining receptacle region of said printer module.

7. A multi-functional printer device according to claim 4, further comprising:

a control system that controls device functions of said printer device;

a monitoring means that acquires one of a presence and absence of said one of said turn-over module and said return module via electrical sensor means and, dependent thereon, supplies a signal to said control system.

8. A multi-functional printer device according to claim 1, further comprising:

an internal supply region that comprises a receptacle region for said turn-over module.

9. A multi-functional printer device according to claim 1, wherein said turn-over module comprises an automatic threading means for the narrow recording medium through said turn-over module.

10. A multi-functional printer device according to claim 9, wherein said turn-over module includes a paper admission channel and a paper turn-over output channel that are arranged next to one another;

a first oblique deflection means that laterally deflects the recording medium supplied via said paper admission channel;

a first reversing means following said first oblique deflection means in a paper conveying direction for returning the recording medium behind said paper channels into a region of a second reversing means that is arranged approximately parallel to said first reversing means and that again reverses the recording medium;

a second oblique deflection means that follows said second reversing means and deflects the recording medium into said turn-over paper output channel; and a threading means for the recording medium, having a motor-driven gripper element guided around said first and second reversing means and comprising gripper means for gripping a start of the recording medium, whereby, for threading into said turn-over means, the start of the recording medium is seized in a region of said first oblique deflection means and is conveyed over said reversing means and said second oblique deflection means into a region of said paper turn-over output channel.

11. A multi-functional printer device according to claim 1, wherein said return channel comprises:

a motor-driven traction roller pair of an input side with respect to the paper conveying direction with a preceding centering means for the narrow recording medium;

a motor-driven traction roller pair of an output side with respect to the paper conveying direction having a transport roller and a pressure roller that are seated displaceable relative to one another; and a connecting channel arranged between said traction roller pairs whose channel width is dimensioned such that a buckling of the recording medium is largely prevented.

12. A multi-functional printer device according to claim 11, comprising:

a shunt following said traction roller pair of said input side in a conveying direction of the recording medium, said shunt having a first operating position wherein the narrow recording medium is conducted into said connecting channel for printing the back side of the recording medium; and having a second operating position wherein a recording medium that is printed on only the front side is conducted into said output channel.

13. A multi-functional printer device according to claim 12, further comprising:

a traction roller pair of said input side which has a transport roller and a pressure roller that are seated displaceable relative to one another, so that, in an opened displaced condition, a through channel for the recording media printed on only one side forms between said rollers.

* * * * *